US005886271A

United States Patent [19]

Zhu et al.

[11] Patent Number: 5,886,271

[45] Date of Patent: Mar. 23, 1999

[54] POWER EXTERNAL OUTPUT MECHANISM IN MUSIC BOX

[75] Inventors: Yunde Zhu; Wei Wang, both of Ningbo, China

[73] Assignee: Ningbo Yunsheng (Group) Co., Ltd., China

[21] Appl. No.: 903,812

[22] Filed: Aug. 1, 1997

[30] Foreign Application Priority Data

Mar. 21, 1997 [CN] China ..... 97104730.8

[51] Int. Cl.[6] ..... G10F 1/06

[52] U.S. Cl. ..... 84/94.2; 84/94.2; 84/95.2

[58] Field of Search ..... 84/94.1, 94.2, 84/95.2

[56] References Cited

U.S. PATENT DOCUMENTS 4,557,173 12/1985 Isaka ..... 84/95 R
4,570,520 2/1986 Deutsch et al. .
4,570,524 2/1986 Isaka et al. ..... 84/96

*Primary Examiner*—William M. Shoop, Jr.
*Assistant Examiner*—Kim Lockett
*Attorney, Agent, or Firm*—Pillsbury Madison & Sutro, LLP

[57] ABSTRACT

A power external output mechanism in muic box comprising a music drum in which a power external output shaft (4) is inserted thereto and integrated with each other in the axial and rotary directions, wherein an engaging means is provided in a drum body (1) of muxic box, by which the drum and the external output shaft are engaged with each other so as to prevent the external output shaft to be break away therefrom, said engaging means is an elastic leg abuttal (5) with a type of thin wall which is formed on an external end plate (2) of the drum and extended inward in aixal direction of the shaft. An inner flange (10) formed on a free end of the leg abuttal (5) and an inner cave annular groove (11) formed on the peripheral surface of the shaft (4) are engaged with each other to form an interlock in axial drection. The inner end plate (3) and an end (9) of the external output shaft (4) are fitted with each other to form a connection in the direction of rotation. The fixation of power output shaft in accordance with the invention is very firm and reliable.

4 Claims, 3 Drawing Sheets

POWER EXTERNAL OUTPUT MECHANISM IN MUSIC BOX

BACKGROUND OF THE INVENTION

The present invention relates to a fixation of power external output shaft in music box and more particularly to a system construction of external output shaft which is fixed firmly in music box.

In the prior art, the U.S. Pat. No. 4,570,524 has disclosed a power external output mechanism (see FIGS. 7 and 8), its external output shaft is fixed in the axial direction by means of that a plurality of elastic arms (16) which integrated with external end plate (4) are in cooperation with a annular groove (14*c*) which is formed on peripheral surface of the external output shaft (14) so as to form its fixation in the axial dirction. However, the firmness of the engagement with each other between the elastic pawls (17) and the annular groove (14*c*) is not so good, thus the external output shaft is easy to break away from the engagement when it is undergone a pull force in axial direction thereof, such is the case that on the music box an attachment such as dolls or the like is to be attached thereto.

SUMMARY OF THE INVENTION

Therefore, an object of the present invention is to provide a power external output mechanism which has an elastic leg clasping relationship between the annular groove of the external output shaft and the elastic pawls being more firmly than the engaging relationship therebetween in the prior art.

The object is achieved by providing:

a power external output mechanism in music box comprising a music drum which is composed of a cylindrial drum body, an inner end plate and an external end plate which are fitted to both ends of this drum body, and an external output shaft which is inserted into the drum so that both of them become integral with each other in the axial and the rotary directions. The drum body is fixed to a base frame of music box through a bearing and a bearing support which are positioned substantially at the central portion of said end plates, a driving torque from a spring will cause the rotation of the drum in music box. An elastic leg abuttal which is provided and become integral with the inner surface of the external end plate on the drum of music box, and which is projected inward from the inner surface of the external end plate and extended in the direction of axis thereof. Said elastic leg abuttal has a continuous leg wall which is made of hollow elastic and thin construction without any opening. The central portiont of said leg abuttal is formed as a hollow cylindrical wall; there is an inner flange projected inward at the free end of the central portion of the leg abuttal, with which the inner flange can engage within the annular groove of peripheral surface of the external output shaft to form an interlock with each other. Furthermore, said leg abuttal has an upright-flat wall portion which passes across the central portion thereof and has a hollow leg wall being arranged in the direction of diameter of the external end plate. In addition, there are some cavity portions in the central portion and the flat wall portion of the leg abutal which are continuously communicated with each other. In order to increase the elastic forces between the thin walls of the leg abuttal which is applied in opposite directions, the wall thickness of the hollow leg abuttal at a position that the flat wall portion and the central cylindrical wall portion are geometrically passed across therebetween may be reduced, so that in such a construction the capacity of engagement for the leg abuttal to engage with the annular groove formed on the external output shaft will be increased.

On the inside of the inner end plate, there is provided with a central projection, on which there is an inner connecting hole with a fitting concave therein. Said connecting hole is fitted with a connecting end of the external output shaft to form a connection in the direction of rotation for the torque transmission. An inner recess of said fitting concave is just fitted with the external projecting of the corresponding connecting end of the external output shaft so as to form a rotary connection which can transfer the torque of rotation. The type as such a fitting relationship may be various, it may be a connecting end of poly-prism shape for fitting with the connecting hole which is of a configuration complementally engaging with that of the connection end, for instance a quadrangular prism-shaped connecting end engages with the connecting hole which has a complement configuration, or a triangular prism-shaped fit as well as a straight-tooth fit with a straight-flute.

The inner end of the external output shaft acts as transmission of the torque of rotation, while the axial fixation of the external output shaft is achieved by means of the annular groove formed on the peripheral surface of the shaft. The width of said annular groove is substantially equal to the thickness of said inner flange formed on the free end of the central portion of said leg abutal at inside of the external end plate, the thickness of the inner flange is only slight less than the width of the annular groove. The external end of the external output shaft can be made a threaded portion for attaching some attachment such as dolls or the like.

The present invention will now be described in detail with reference to the accompanying drawings.

The present invention will now be described in detail with reference to the accompanying drawings.

DETAILED DESCRIPTION OF THE PREFERED EMBODIMENT

Figure 1:
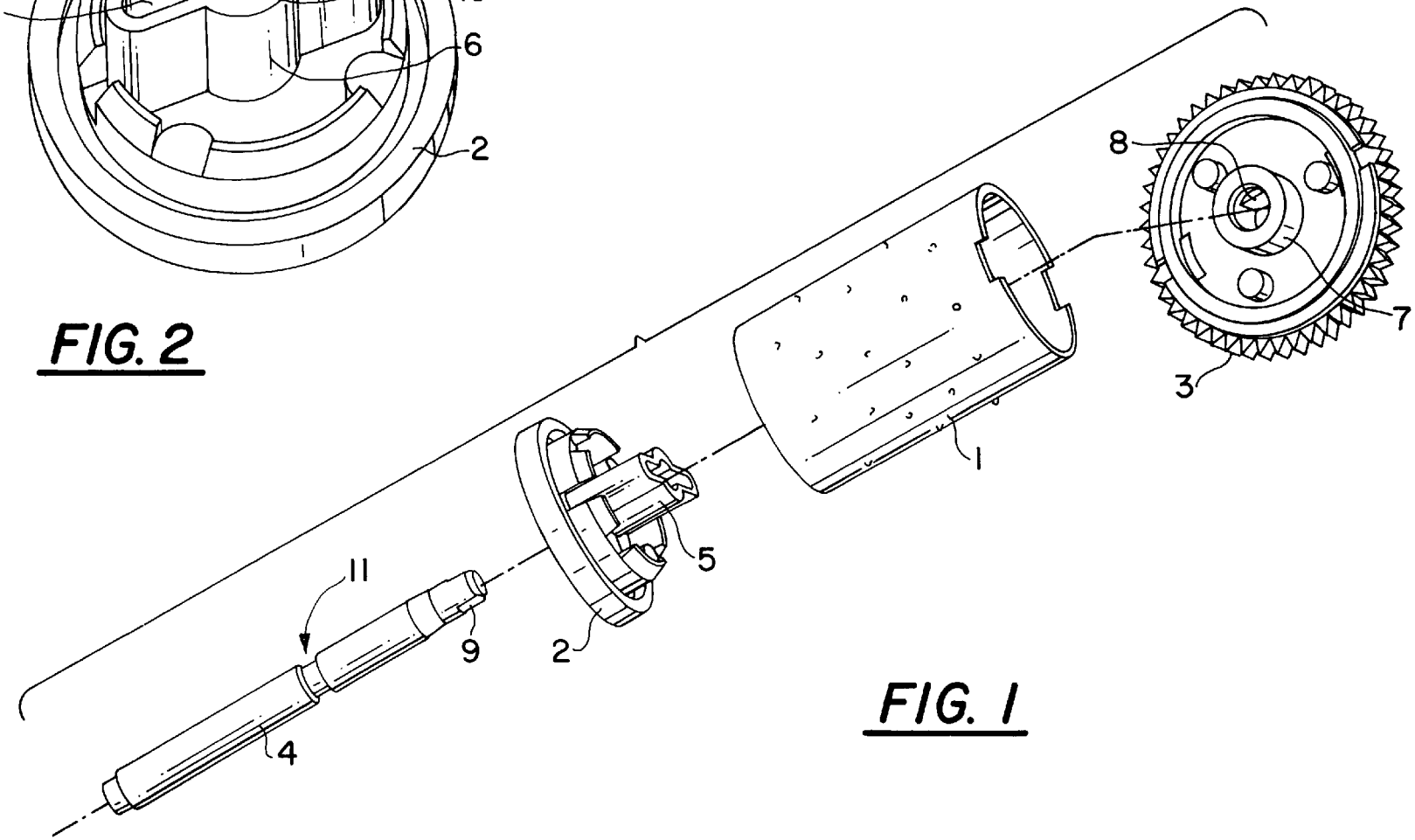
FIG. 1 is an exploded perspective view showing the first embodiment of a power external output shaft mechanism in music box in accordance with the present invention.
Figure 2:
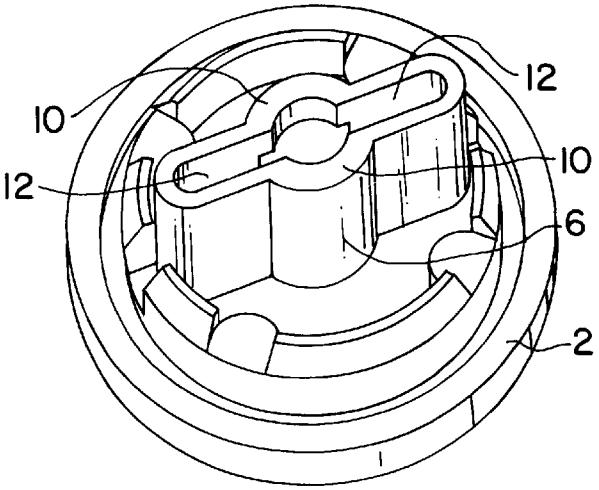
FIG. 2 is a perspective view showing an external end plate of a music drum in the first embodiment of the invention.
Figure 3:
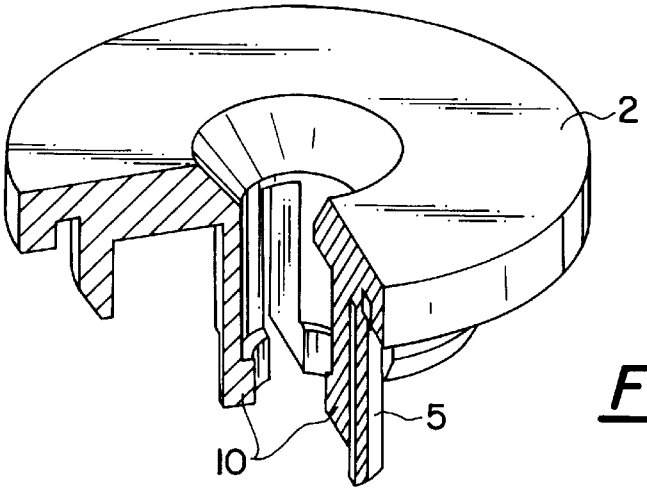
FIG. 3 is a cross-sectional perspective view showing an external end plate of a music drum in the first embodiment of the invention.
Figure 4:
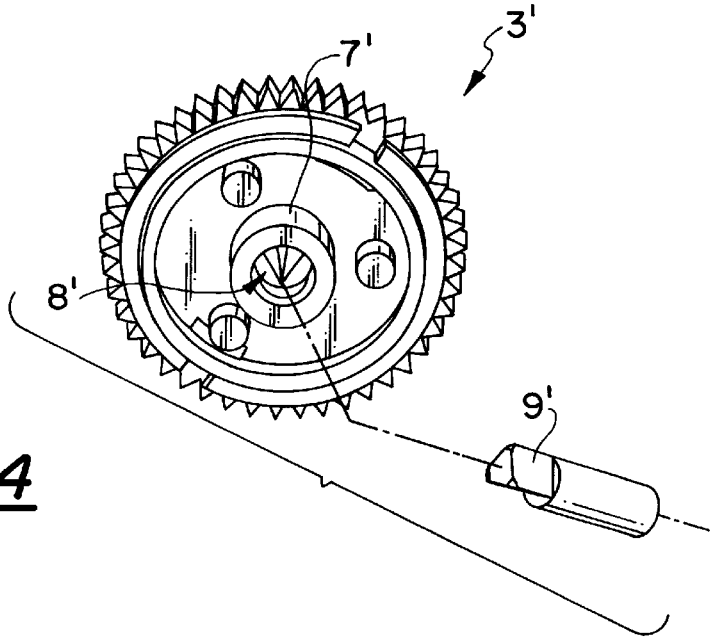
FIG. 4 is an exploded perspective view showing a disassimbled state between the inner end plate of music drum and the power external output shaft in the second embodiment of the present invention.
Figure 5:
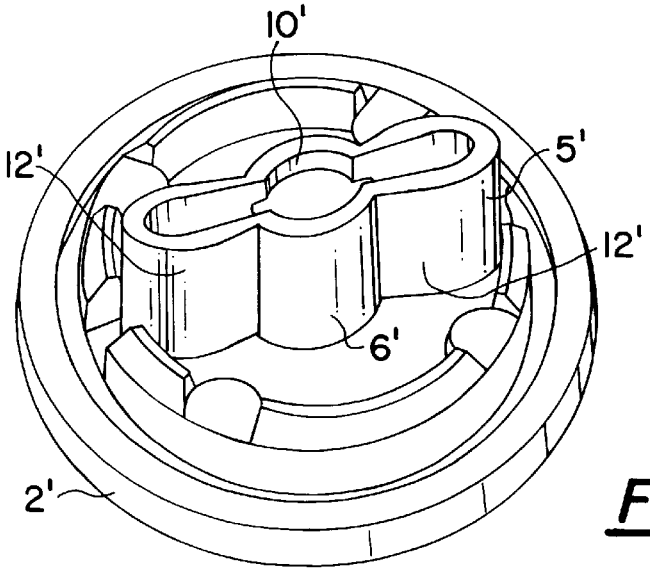
FIG. 5 is a perspective view showing an external end plate of a music drum having a hollow elastic leg abuttal in the second embodiment of the invention.
Figure 7:
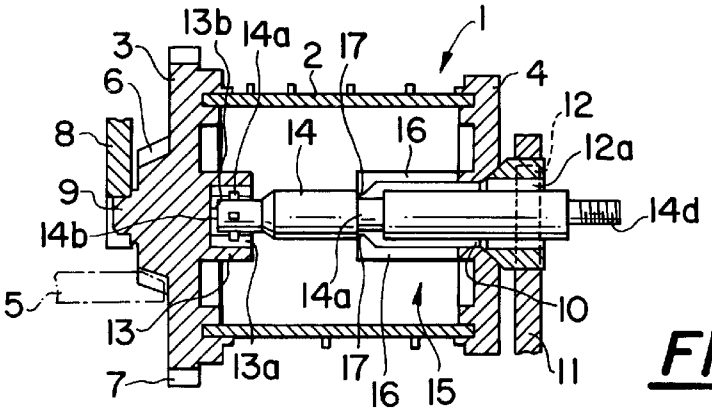
FIG. 7 is a cross sectional view showing a drum in music box longitudinally taken in axial direction in the prior art.
Figure 8:
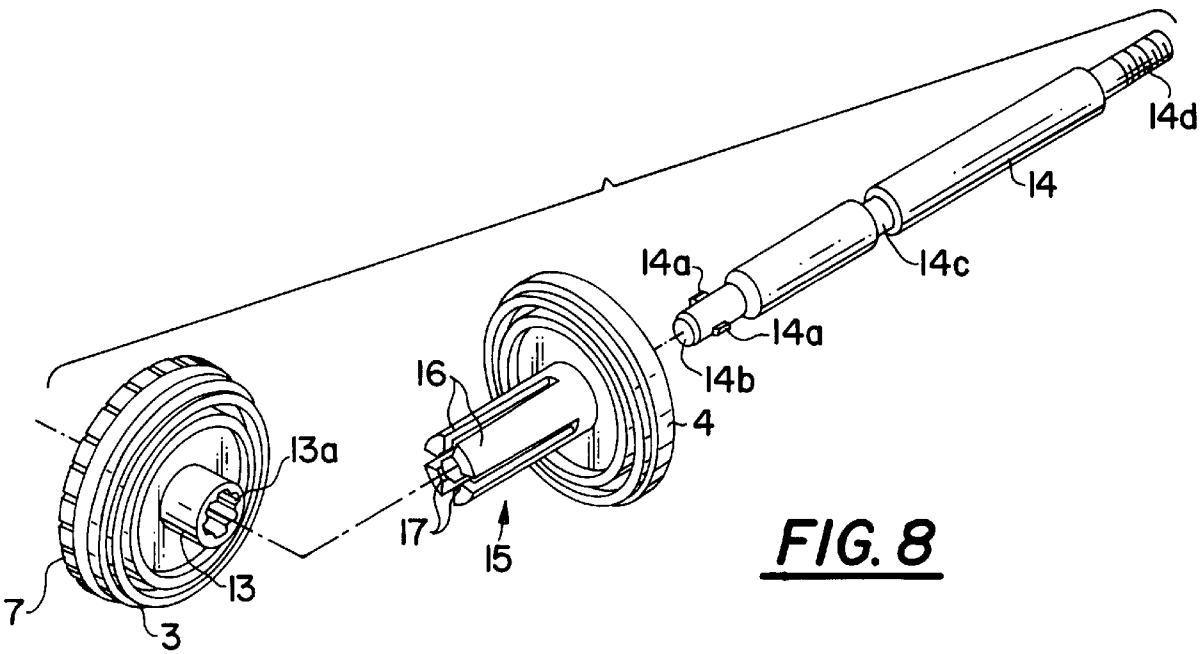
FIG. 8 is an exploded perspective view showing the power external outputshaft of the prior art.
Figure 6:
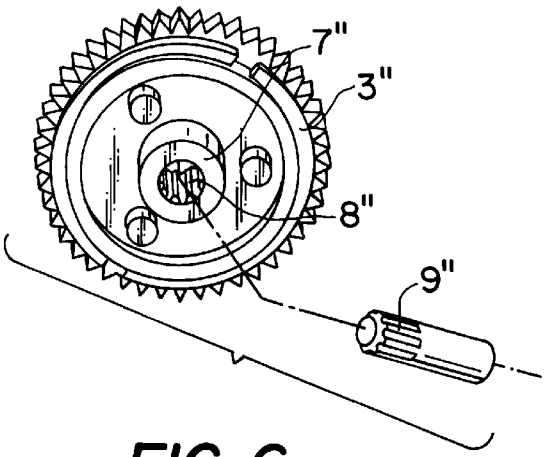
FIG. 6 is an exploded perspective view showing a disassembled state between the inner end plate of music drum and the external output shaft in the second embodiment of the invention.

The first embodiment of the power external output mechanism of the present invention is shown in FIG. 1 to FIG. 3. As seen in the figures, a music drum of the invention is composed of a hollow cylindrical drum body 1, an external end plate 2 and an inner end plate 3. An external output shaft 4 via a central hole of the external end plate 2 is inserted into a hollow inner chamber of central cylindrical leg wall 6 formed on a hollow elastic leg abutal 5, and then passes through the drum body 1, finally reaches in a connecting hole 8 which is formed on a central projection 7 inside of the inner end plate 3. The connecting end 9 of the external output shaft 4 is of quadrangular prism-shaped, with which the connecting hole 8 of the central projection 7 having a comlementary configuration thereto, is fitted on, so that between them form a connecting-fit is formed in the direction of rotation. On the other hand, an inner flange 10 formed on the free end of the central cylindrical leg wall 6 and an inner cave groove 11 formed on the peripheral surface of the external output shaft 4 are engaged with each other for connecting in the direction of axis. Said hollow leg abuttal 5 includes a portion of central cylindrical leg wall 6 which is provided for the external output shaft 4 to insert therein and engaged with each other, and a portion of upright flat wall 12 which has a hollow leg arranged in the direction of diameter of the external end plate; these two portions are in geometrically passing across, and their inner chambers are communicated with each other so as to form connection. Said hollow elastic leg abuttal 5 has two opposite thin walls, between which an elastic forces appears to cause the walls to close together; upon the elastic forces said inner flange 10 will engage with the inner cave groove 11 of the external output shaft 4 so as to form a connection and fixation between the music drum and the external output shaft in the direction of the shaft.

The total construction of the second embodiment of the invention is in general same as that of the first embodiment, however the distiction is that as a connection in the direction of rotation, the connecting end 9' of the external output shaft 4 is of a triangular prism shaped, and the conecting hole 8 formed on the central portion 7' of the inner end plate 3' is also in a shape of complemented with that of said connecting end 9'. In addition, the upright leg abuttal 5' formed on the inside of said external end plate 2' is further formed in such a way that the hollow thickness of said upright leg wall at the place where the straight flat leg wall 12' passes across the central clindrical leg wall 6' is to be reduced, so that the elstic clasping forces for the inner flange 10' to engage with the annular groove 11 formed on the external output shaft 4 will be reduced, and the fixation in the direction of the shaft is more firmly.

The total construction of the third embodiment of the invention is also in general same as that of the first embodiment; the distiction is that the conecting end 9" of the external output shaft has a plurality of straight teeth arranged on the peripheral surface thereof, and the connecting hole 8" formed on the central projection 7" of the inner end plate 3" is in correspoding straight-flute shaped one.

The advantages of the present invention are that in music box the firmness of the connection in axial direction between the power external output shaft and the music drum body is greatly increased, and also the capacity of load for the drum in axial direction is increased. Furthermore, the force for the external saft to be inserted into the music drum is less, so it is easy to insert thereto, and the firmness and the reliability of the fixation of the external output shaft is strengthened.

What is claimed is:

1. A power external output mechanism in music box comprising:

a music drum which is composed of a cylindrical drum body, an inner end plate and an external end plate which are fitted to two opposite ends of the drum body, an external output shaft which is inserted into the music drum so that both of them become integral with each other in the aixal direction and the rotary direction of said shaft, said drum body is fixed to a base frame of music box through a bearing and a bearing support which are positioned substantially at the central part on said end plates, a driving torque from a spring will cause the rotation of the drum in music box;

wherein an elastic leg abuttal is provided and become integral with a inner surface of said external end plate on said drum, and which is projected inward from said inner surface of the external end plate and extended in the direction of axis thereof; said leg abuttal having a continuous leg wall which is made of hollow elastic and thin construction;

said leg abuttal having a central portion which is formed as a hollow cylindrical wall and a portion which is formed as hollow upright flat wall and passes across said central portion, wherein some inner chambers in both portions are communicated with each other; an inner flange projected inward at a free end of said central portion of the leg abutal, said hollow upright flat wall being arranged in the direction of diameter of the external end plate;

a central projection is formed inside of said inner end plate; a connecting hole is formed on said central projection and fitted with a connecting end of said external output shaft which is inserted thereto;

an annular inner cave groove formed on peripheral surface of the external output shaft, the width of said annular groove is substantially equel to the thickness of said inner flange, the former is slightly more than the later.

2. A power external output mechanism according to claim 1, wherein the thickness of said leg abuttal wall at a position that the upright flat wall portion and the central cylindrical wall portion are passed across therebetween can be reduced.

3. A power external output mechanism according to claim 1, wherein the connection between said external output shaft and said central projection of the inner end plate is a fit between said connecting end of poly-prism shape and said connecting hole of corresponding shape therewith.

4. A power external output mechanism according to claim 1, wherein the connection between said external output shaft and said central projection of the inner end plate is a fit between said cnnecting end having a plurality of straight teeth formed on the peripheral surface of said shaft and said connecting hole having a plurality of straight flutes formed on the inner peripheral surface.

* * * * *